US007530659B2

(12) United States Patent
Doherty et al.

(10) Patent No.: US 7,530,659 B2
(45) Date of Patent: May 12, 2009

(54) IMAGER UNITS

(75) Inventors: Neil Doherty, San Diego, CA (US); Robert J. Fogarty, San Diego, CA (US); Myron A. Bezenek, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 323 days.

(21) Appl. No.: 11/395,446

(22) Filed: Mar. 31, 2006

(65) Prior Publication Data

US 2007/0229562 A1 Oct. 4, 2007

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS

| | | | | |
|---|---|---|---|---|
| 5,229,787 | A * | 7/1993 | Rees et al. | 347/115 |
| 6,359,638 | B1 * | 3/2002 | Saeki | 347/116 |
| 7,370,933 | B2 * | 5/2008 | Kusakari et al. | 347/19 |
| 2005/0270329 | A1 * | 12/2005 | Hoisington et al. | 347/42 |

* cited by examiner

*Primary Examiner*—Matthew Luu
*Assistant Examiner*—Justin Seo

(57) ABSTRACT

Embodiments including imager units are disclosed.

10 Claims, 6 Drawing Sheets

IMAGER UNITS

INTRODUCTION

Industrial and commercial printing systems can employ the use of inkjet printing devices having multiple imager units containing multiple printheads for high volume print jobs. In such devices, alignment (e.g., stitching together of information printed by two adjacent printheads), can be difficult.

DETAILED DESCRIPTION

Figure 1:
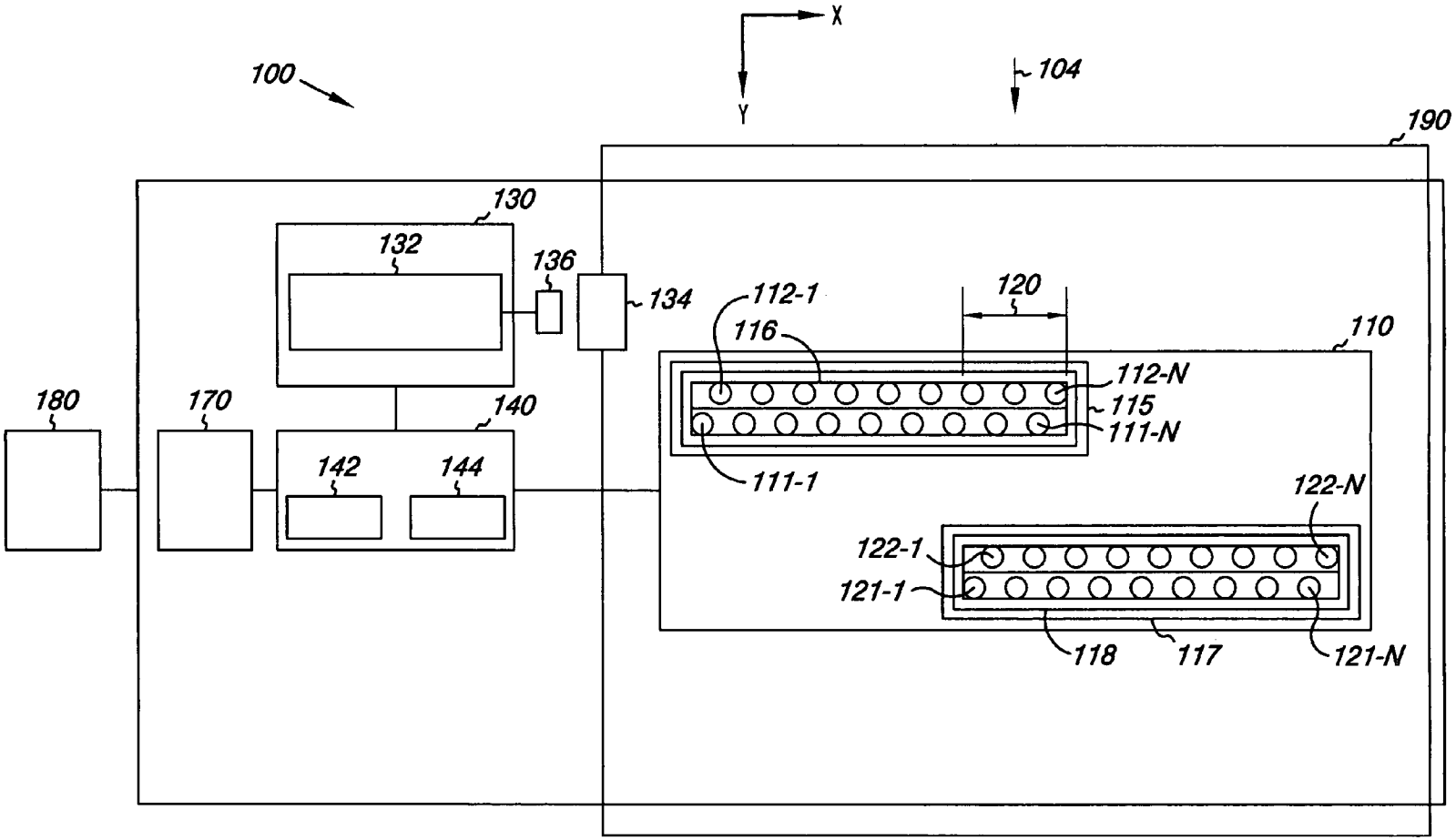
FIG. 1 illustrates an embodiment of a printing system.

Commercial inkjet printing devices, such as fixed wide-array inkjet printing devices, use an array of non-scanning printheads arranged in a parallel configuration within imager units that can span the width of the print medium perpendicular to the direction of print medium travel.

The printheads can be arranged, for example, in a staggered configuration and held stationary relative to the print medium as a non-continuous form, such as a cut sheet, and/or continuous form, such as a continuous web of print medium, is advanced past the printheads. Some staggered printhead arrays can contain up to 32 printheads. Alignment (e.g., stitching) can be difficult for output printed by two adjacent printheads, for example, for straight lines printed across an overlap between two imager units in a staggered configuration.

In fixed head imager units constructed with multiple printheads, defects in a printed output (e.g., an image) may arise at the stitching connection created by the overlap of the imager units with multiple printheads. These defects can, for example, result from displacement encoder measurement error, variations in imager unit spacing, along with the spacing of the printheads therein, and deformities in the print medium, among other factors. A contributor to stitching error can be periodic displacement encoder errors that can result from eccentricities within the encoder or in an encoder wheel, mounting of the encoder, and/or characteristics of the roll of continuous web print medium and/or mounting of such on the device.

Attempts to reduce the eccentricities of the encoder wheel and the displacement encoder itself are limited by the combined manufacturing tolerances of the wheel, the mounting, and the encoder. When encoders are driven by gears to match spacing between imager units, the gears themselves may introduce errors analogous to those resulting from eccentricities in the encoder and the encoder wheel.

Embodiments of the present disclosure include methods, apparatuses, and systems, including logic operable to execute and control such, to reduce print alignment issues based upon imager unit positioning, eccentricities in the encoder wheel associated with the imager unit, mounting of the encoder, and/or characteristics of a roll of continuous web print medium and/or mounting of such on the device, if utilized.

Displacement encoders can be used to identify the movement of a print medium in a variety of manners. For example, in some embodiments, a displacement encoder can be used that can sense encoding marks on a web of print medium and transmit encoder signals that contain data about the encoding marks. Logic can use the data from the encoder signals to determine the motion of the print medium with respect to a sensor associated with the displacement encoder. The encoder signals and time information can be used by the logic calculate the velocity, position, and acceleration of the print medium.

In some embodiments, logic can use encoder signals to determine the angular motion of a rotating object. For example, a radial array of encoder marks, such as those on an encoder wheel, can be connected to the rotating object, so that the displacement encoder can sense the encoding marks as the object rotates. In such an apparatus, the radial array may be centered on the axis of rotation of the rotating object, so that the angular rotation of the array correlates with the angular rotation of the object; thus, the number of encoder marks passing by an optical sensor, or a frequency at which they do so, can be used for determining appropriate placement of imaging by multiple printheads in multiple imager units configured in a staggered array, for example.

When a radial array of encoding marks is connected to a rotating object where the array is not centered on the object's axis of rotation, then the angular rotation of the array may not correlate with the angular rotation of the object. In such devices, when a single displacement encoder senses the encoding marks of the off-center array and transmits encoder signals based on the marks, data in the signals may contain an eccentricity error, so that logic may not be able to use the data to accurately determine the angular motion of the rotating object. Resultant errors in calculation of print medium travel distances can result, thereby causing misalignment (e.g., stitching errors) in portions of images printed, for example, by adjacent, although staggered, imager units.

FIG. 1 illustrates an embodiment of a printing system. FIG. 1 illustrates an embodiment of a printing system 100 that includes a staggered, stationary inkjet printhead assembly 110 split into two imager units 115 and 117.

The term staggered, as utilized in the present disclosure, is used to indicate that components of a device or system may be oriented in various spacial relationships to each other (e.g., oriented diagonally to each other, parallel to each other across the width of the print medium, or oriented in-line in the direction of print medium movement). For instance, in the embodiment of FIG. 1, staggered is used to indicate that the printheads of a printing system are arranged in a configuration that extends across at least a portion of the width of the print medium.

As stated above, staggered also can indicate that the printheads of the printing system are arranged in a substantially in-line configuration so as to facilitate, for example, faster printing by enabling different printheads to simultaneously print different portions of an image and/or by enabling specified printheads to apply specified colors to contribute to the image on the print medium.

The term imager unit, as utilized in the present disclosure, indicates a component for applying material to the print medium in the printing system so as to form a desired image (e.g., text, picture, mixed media, etc.) on the print medium. Embodiments of the present disclosure, as illustrated in FIG. 1, can use one or more ink-jet printheads associated in such a manner as to provide an imager unit that ejects ink droplets to form an image, however, imager units are not so limited as to use of ink-jet printheads, and may use other types of image forming mechanisms therein.

In the embodiment of FIG. 1, two pairs of staggered printheads 116 and 118 are positioned within each of the two separate imager units 115 and 117. The two staggered printheads included in 116 and 118 eject drops of ink through a plurality of orifices or nozzles. For example, nozzles 111-1 through 111-N constitute one printhead that ejects ink drops onto a print medium 190 so as to form a printed output onto print medium 190.

In the embodiment of FIG. 1, the nozzles are arranged in two printheads for each imager unit. Since the printheads can be positioned horizontally and perpendicular to the direction of print media travel 104, columns of nozzles appear as rows due to the horizontal, rather than the vertical, positioning within imager units 115 and 117. Various embodiments of the present disclosure can include various numbers of imager units containing various numbers of printheads with various numbers of nozzles and/or in different orientations than shown in FIG. 1.

In the embodiment shown in FIG. 1, the first imager unit 115 includes a stationary mechanical mounting device for receiving a pair of staggered printheads 116 and for positioning the printheads 116 within the printing device 100. However, the embodiments of the invention are not limited to the use of imager units, to the number of imager units, the number of printheads on each imager unit, the imager units or the printheads being stationary, or the imager units or the printheads being staggered. The first printhead within imager unit 115 includes a first nozzle column including nozzles 111-1 through 111-N. A second printhead with a nozzle column includes nozzles 112-1 through 112-N.

A second imager unit 117 includes a stationary mechanical mounting device for receiving a pair of staggered printheads 118 and for positioning printheads 118 within the printing device 100. The first printhead of the second imager unit 117 includes nozzles 121-1 through 121-N. A second printhead with a nozzle column includes nozzles 122-1 through 122-N. The printhead with nozzle 121-1 through nozzle 121-N can be configured in a parallel and staggered position relative to the printhead with nozzles 122-1 through 122-N.

In various embodiments, imager units are spaced apart and staggered such that the nozzles of each imager unit can overlap the nozzles of one or more adjacent imager units to permit full coverage of ink drop placement on the print medium. In the embodiment of FIG. 1, the second imager unit 117 is positioned offset in the X direction and parallel to the first imager unit 115, thus creating a nozzle overlap zone 120 between the nozzles of first printheads 116 and the nozzles of second printheads 118.

The nozzle overlap zone 120 bounds a varying number of rightmost nozzles of first printheads 116 and a varying number of leftmost nozzles of second printheads 118 such that in the overlap zone 120, and to either side, straight and curved lines that are intended to be continuous may be broken by improper stitching. Improper stitching of lines in an output can be due to displacement of printing by an imager unit upstream or downstream of its correct position resulting from eccentricity of a displacement encoder and its associated encoder wheel, and/or deformities and eccentricities in print media, such as cut sheets and/or a roll of continuous web print medium. Embodiments of the present disclosure can be used to reduce stitching errors.

In various embodiments, a printing system can include a controller. The controller can, for example, include, or be associated with, logic and sensing components for identifying print medium positioning and/or ink drop projection. In the embodiment shown in FIG. 1, for example, the printing system includes a controller 140. The controller 140 can, for example, include logic and sensing mechanisms for identifying print medium positioning and/or ink drop ejection. The controller 140 can include memory 142 and a processor 144 and can be electrically coupled to a printhead array 110, a paper path mechanism 130 including a displacement encoder 132, an encoder wheel 134, a sensor 136 (e.g., an optical and/or electrical sensor), and a user interface 170 (e.g., a display, keyboard, touch screen, and/or other interface mechanism).

The controller 140 can receive printing instructions from a number of sources including the user interface 170 available on the printing system 100 or from a remote device 180, among other sources. The controller 140 can use logic from the processor 144 to execute printing instructions according to, for example, software (e.g., computer executable instructions) stored in memory 142.

Accordingly, the memory 142 in controller 140 can include software having executable instructions to control the ejection of ink from the nozzles of the printheads 116 and 118 to print an ink placement pattern (e.g., image) on print medium 190. Memory 142 can include volatile and/or non-volatile memory types.

The memory 142 can store data including software, printing instructions, and/or data from a number of sources, including the displacement encoder 132. The memory can be accessed by the processor, which can process the data stored in the memory. For example, the processor 144 can operate on the data received from a displacement encoder 132 to adjust the timing for ejecting ink droplets from nozzles on printheads 116 and/or 118 to reduce stitching errors between portions of images printed by printheads 116 and 118 in imager units 115 and 117, respectively.

FIG. 1 illustrates an embodiment of a paper path mechanism 130 having a displacement encoder 132. The displacement encoder 132 can measure the position of the print medium 190 relative to the staggered, stationary printhead array 110 and the sensor 136 based upon, by way of example and not by way of limitation, rotation of the encoder wheel 134 displaying a radial array of encoder marks detectable by the sensor 136 so that the displacement encoder 132 can sense the encoding marks as the encoder wheel 134 rotates. By the processor 144 interpreting the data received from the displacement encoder 132, calculations can be made with respect to future positions of the print medium. This may enable more accurate timing of ink drop ejection for downstream nozzles in the same imager unit, along with nozzles of printheads in downstream imager units.

The displacement encoder utilized in the various embodiments can be of any suitable type. For example, in the embodiment of FIG. 1, the displacement encoder 132 can be a rotational encoder with an encoder wheel 134 that rotates with the movement of the print media to indicate print media positioning. The displacement encoder 132 generates a signal based upon the rotation of the encoder wheel 134, which can be used to measure a distance and/or speed of print medium advancement. The displacement encoder 132 can send print medium positioning data back to the controller 140 as the ink placement pattern is printed and the medium is advanced 104. In this manner, the controller 140, of the embodiment of FIG. 1, can use the print medium advance data to control the timing of printhead ink ejection.

Figure 2:
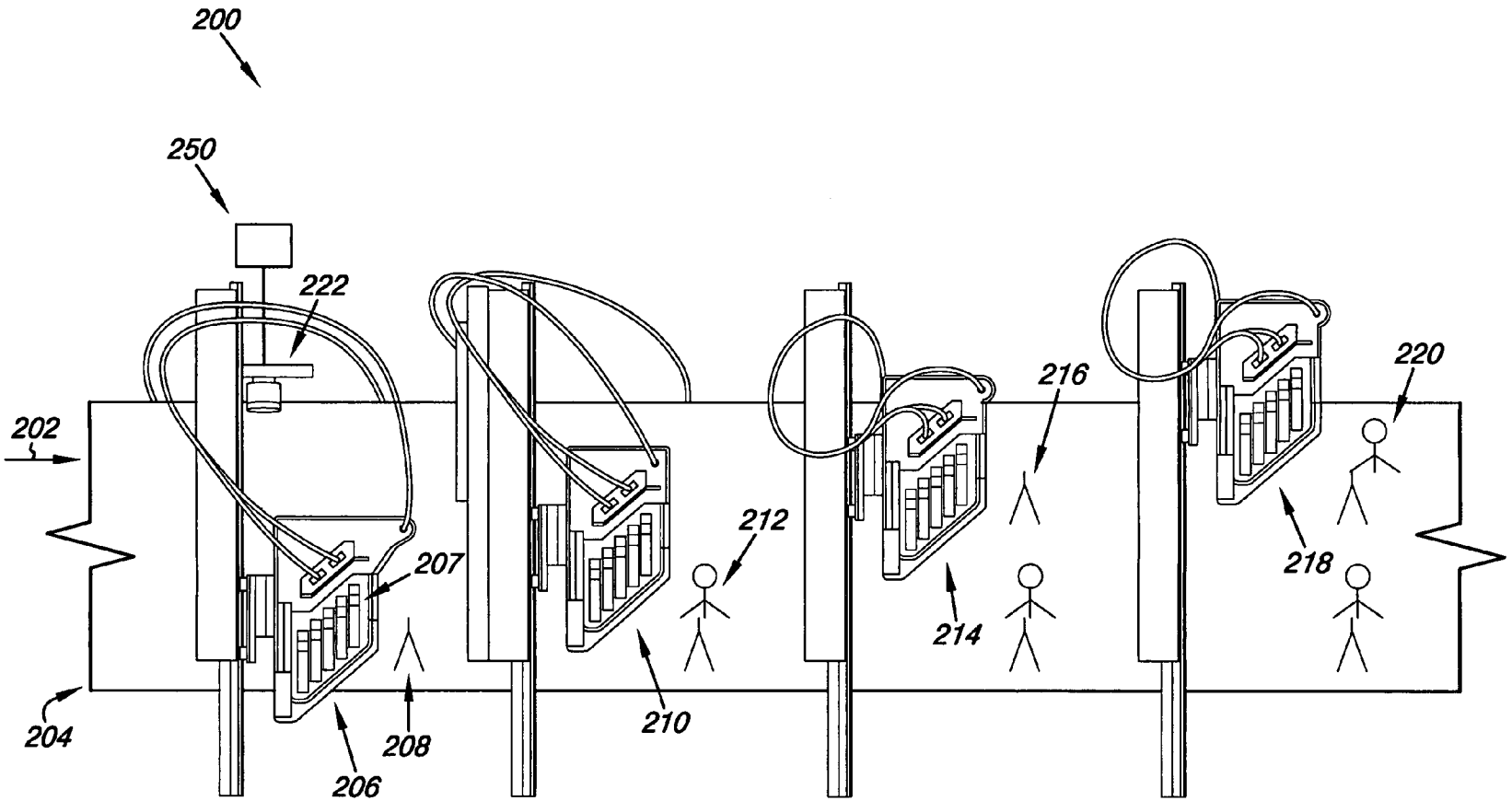
FIG. 2 illustrates an embodiment of a printing system having a number of imager units.

FIG. 2 illustrates an embodiment of a printing system having a number of imager units. As shown in the embodiment of FIG. 2, the components for the printing system 200 for printing images on the print medium 204 can include a number of imager units (e.g., imager units 206, 210, 214, and 218).

Each imager unit can have at least one printhead residing thereon. For example, in the embodiment of FIG. 2, imager unit 206 is shown with five printheads 207 arranged in a substantially parallel, staggered configuration thereon. As the print medium 204 progresses in the direction of print medium advancement 202, the printheads in the imager units form at least portions of images by ejecting ink droplets on the print medium.

In the example illustrated in FIG. 2, the printheads 207 on a first imager unit 206 have formed a bottom portion of an image output of a stick man 208. As the print medium 204 advances further, a second imager unit 210 adds a top portion of the stick man 212 to the bottom portion 208 already formed by the first imager unit 206. Similarly, as the print medium 204 advances, a third imager unit 214 begins a new image output by forming a bottom portion 216 of a second stick man. As the print medium 204 advances past a fourth imager unit 218, a top portion 220 of the second stick man is formed.

Also shown in FIG. 2 is an encoder wheel 222 positioned proximate to, and upstream of, the first imager unit 206, as illustrated by encoder wheel 134 in FIG. 1. As described with regard to FIG. 3, when the radial array of encoding marks 306 is not centered on the axis of rotation of the encoder wheel 303, data in the encoder signals transmitted by the sensor 310 contain an eccentricity error. Errors can cause miscalculation by the controller 350 of the displacement of the print medium in contact with and rotating the encoder wheel 303 and/or the speed of the print medium going past the location of the encoder wheel 303. This can result in mistiming of ejection of ink drops from printheads on imager units, which can, consequently, cause improper stitching of portions of images formed by adjacent imager units.

As illustrated in FIG. 2, errors contained in signals can have cumulative effects the further downstream an imager unit is from the encoder wheel 222 that receives instructions from the controller (not shown) based on data provided by the encoder wheel 222 through its associated displacement encoder 250. For example, the lower portion 208 of the first stick man is formed by the first imager unit 206 based upon positioning information provided by the encoder wheel 222 and its associated displacement encoder 250; placement of the upper portion 212 of the first stick man by the second imager unit 210 also is based upon the same positioning information provided by encoder wheel 222 and its associated displacement encoder 250. If the encoder wheel 222 contributes an eccentricity error to the positioning information through the displacement encoder 250, the controller provides erroneous information to the printheads in the second imager unit 210 for timing of ejection of ink drops to form the upper portion 212 of the first stick man.

As shown in FIG. 2, mistiming the ejection of ink drops based on an error originating in the encoder wheel 222 can cause erroneous stitching of the top and bottom portions of the first image, in this case, the first stick man. This supply of erroneous information by the encoder wheel and its associated displacement encoder, along with contributing different characteristics of the print medium, can cause a cumulative error for timing of ink drop ejection by printheads that, in some systems, can grow the further away a downstream imager unit is from the encoder wheel and its associated displacement encoder.

For example, the lower portion 216 of the second stick man is formed by the third imager unit 214 based upon positioning information provided by encoder wheel 222 and its associated displacement encoder; placement of the upper portion of the first stick man by the second imager unit 210 also is based upon the same positioning information provided by the upstream encoder wheel 222 and its associated displacement encoder. Because the second stick man is separated from the first stick man, cumulative errors in output placement may go undetected by an observer. However, placement of the upper portion 220 of the second stick man by the fourth imager unit 218 also is based upon the same positioning information provided by encoder wheel 222 and its associated displacement encoder 250, which have continuously been providing positioning information containing the eccentricity error, and the stitching of the upper 220 and lower 216 portions of the second stick man is misaligned even further than the stitching of the upper 212 and lower 208 portions of the first stick man.

Figure 3:
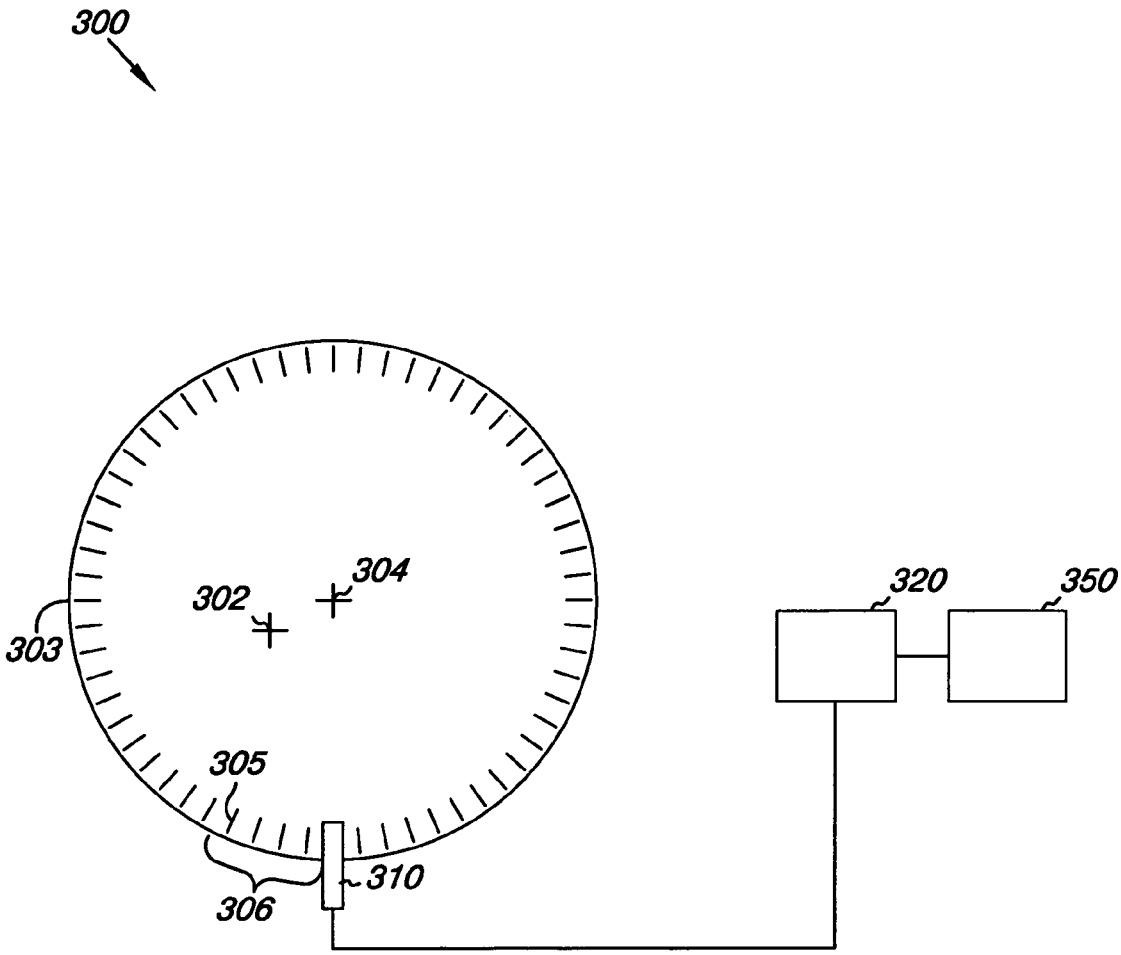
FIG. 3 illustrates an embodiment of an encoder wheel of a displacement encoder.

FIG. 3 illustrates an embodiment of an encoder wheel of a displacement encoder. FIG. 3 shows an embodiment of an encoder component 300 having an encoder wheel 303 electronically connected to a displacement encoder 320 and a controller 350.

The encoder wheel 303 includes encoder mark 305, which is part of a radial array of encoder marks 306. Individual ones of the encoder marks in the radial array of encoder marks 306 can be sensed by a sensor 310, which by way of example and not limitation can be an optical sensor.

In the embodiment illustrated in FIG. 3, the radial array of encoder marks 306 is centered on an array center 304. However, the encoder wheel 303 rotates around an axis of rotation 302. As shown, the array center 304 does not coincide with the axis center 302. Such misalignment can be due to tolerances in the manufacture of the encoder wheel 303, the mounting structure, and/or the displacement encoder 320, and/or the mounting of the encoder wheel, among other reasons.

In such embodiments, the distance between an array center and an axis center may cause a wobble of the radial array on the encoder wheel that is perceived by the sensor as a periodic variation in speed. Such periodic speed variation resulting from the eccentricity of the array center and an axis center can result in the displacement encoder supplying erroneous data to the controller for timing of ink droplet ejection.

Each sensor 310 is capable of sensing individual ones of the encoder marks in the radial array of encoder marks 306 as the encoder wheel 303 rotates. Each sensor 310 is capable of transmitting encoder signals based on passage of the encoder marks they sense. In the embodiment of FIG. 3, because the radial array of encoding marks 306 is not centered on the axis of rotation of the encoder wheel 303, data in the encoder signals transmitted by the sensor 310 may contain an error.

The sensor 310 is connected with a displacement encoder 320, so that the displacement encoder 320 can receive the signals transmitted by the sensor 310. The displacement encoder 320 is associated with the controller 350 that includes logic operable to use the data in the encoder signals transmitted by the displacement encoder 320 to determine the angular motion of the encoder wheel 303 as affected by the eccentricity error, as described herein. The controller 350 can also include logic operable to convert output signals that represent the angular motion of the encoder wheel 303 into signals representing the displacement of the print medium in contact with and rotating the encoder wheel 303 and/or the speed of the print medium going past the location of the encoder wheel 303.

Such information can be used to adjust ink ejection timing. Such functions can be accomplished in a variety of manners. For example, a user can input eccentricity information and/or the device can include logic to compare the positions of marks sensed by the sensors, among other methods.

Figure 4:
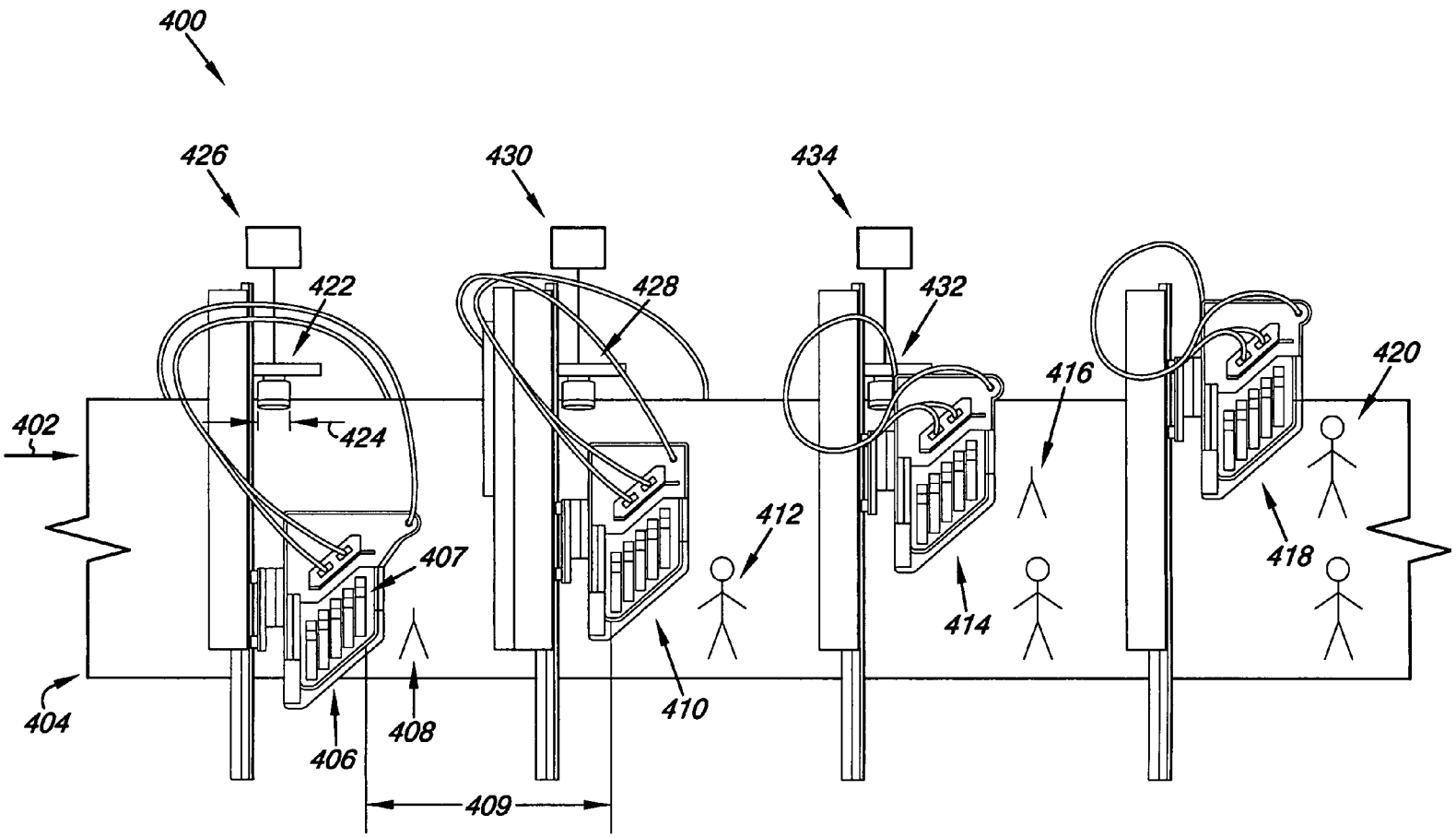
FIG. 4 illustrates another embodiment of a printing system having a number of imager units.

FIG. 4 illustrates another embodiment of a printing system having a number of imager units. As shown in the embodiment of FIG. 4, the components for the printing system 400 for printing images on the print medium 404 can include a number of imager units (e.g., imager units 406, 410, 414, and 418). FIG. 4 represents an embodiment of an imaging system configured to compensate, at least partially, for errors used in ink ejection calculations. Such are can result from, for example, eccentricity of an encoder wheel and/or its associated displacement encoder and/or differences in the characteristics of the print medium being used.

The imaging system shown in FIG. 4 includes an encoder wheel 422 and displacement encoder 426 shown associated with the first imager unit 406. In addition, the imaging system shown in FIG. 4 includes an encoder wheel 428 and a displacement encoder 430 associated with a second imager unit 410. The imaging system shown in FIG. 4 also includes an encoder wheel 432 and a displacement encoder 434 associated with a third imager unit 414.

As shown in FIG. 4, a distance 409 is measured between a last printhead of printheads 407 residing on the first imager unit 406 and a first printhead residing on the second imager unit 410. In addition, a distance 424 representing a diameter of the encoder wheel 422 is shown in FIG. 4.

By multiplying the distance 424 representing the diameter of the encoder wheel by $\pi$, the calculation can yield an approximate circumference of the encoder wheel 422. In the embodiment illustrated in FIG. 4, the distance 409 separating the last printhead of the first imager unit 406 and the first printhead of the second imager unit 410 is approximately equal to an integer multiple of the circumference of the encoder wheel.

Moreover, a first printhead of the third imager unit 414 can be separated from a last printhead of the second imager unit 410 and a first printhead of a fourth imager unit 418 can be separated from a last printhead of the third imager unit 414 by approximately the same distance as the distance 409 measured between the last printhead of the first imager unit 406 and the first printhead of the second imager unit 410, as is illustrated in the embodiment of FIG. 4. As such, in the embodiment of FIG. 4, all of the last printheads of the imager units shown in FIG. 4 (except that of the fourth imager unit 418) are separated from the first printhead of a next imager unit by an approximate integer multiple of the circumference of the first encoder wheel 422.

Moreover, because the second imager unit 410 has an associated encoder wheel 428 and displacement encoder 430, the third imager unit 414, and imager units further downstream, can be separated from the second imager unit 410 by an approximate integer multiple of the circumference of the second encoder wheel 428. Similarly, because the third imager unit 414 has an associated encoder wheel 432 and displacement encoder 434, the fourth imager unit 418, and imager units further downstream, can be separated from the third imager unit 414 by an approximate integer multiple of the circumference of the third encoder wheel 432. In such embodiments, the other imagers can be positioned based upon their distance from the imager unit closest to the encoder wheel to which they are to be associated, or based upon an adjacent imager unit.

Figure 6A:
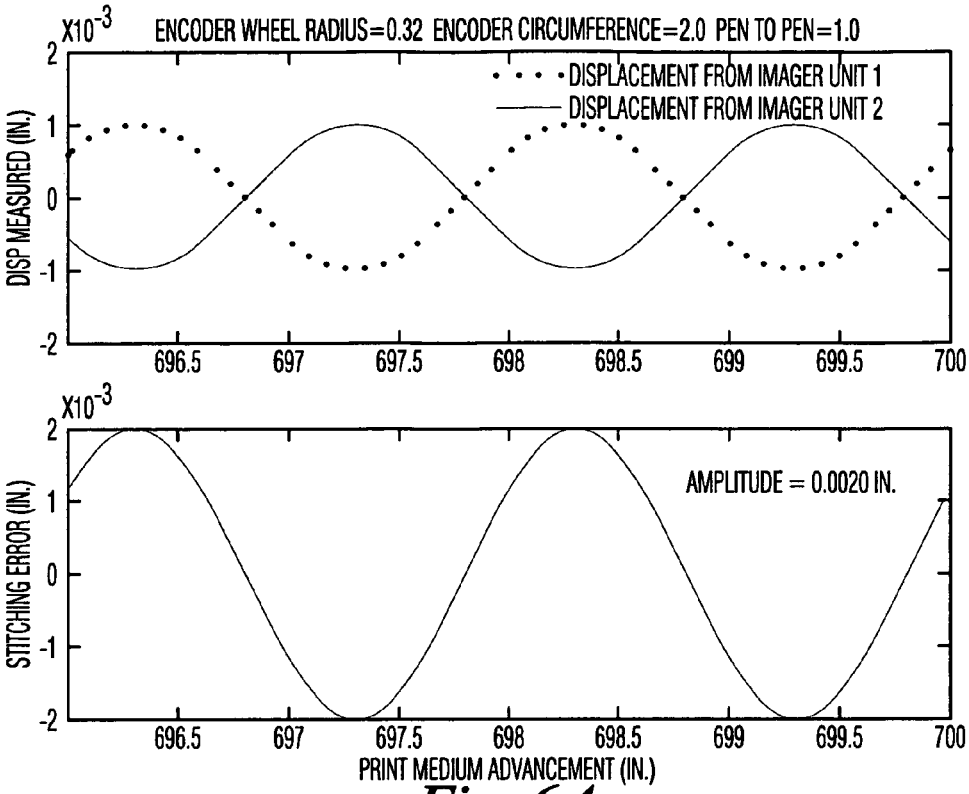
FIGS. 6A and 6B illustrate graphs representing a correlation between imager unit spacing and stitching error for an embodiment of a printing system.
Figure 6B:
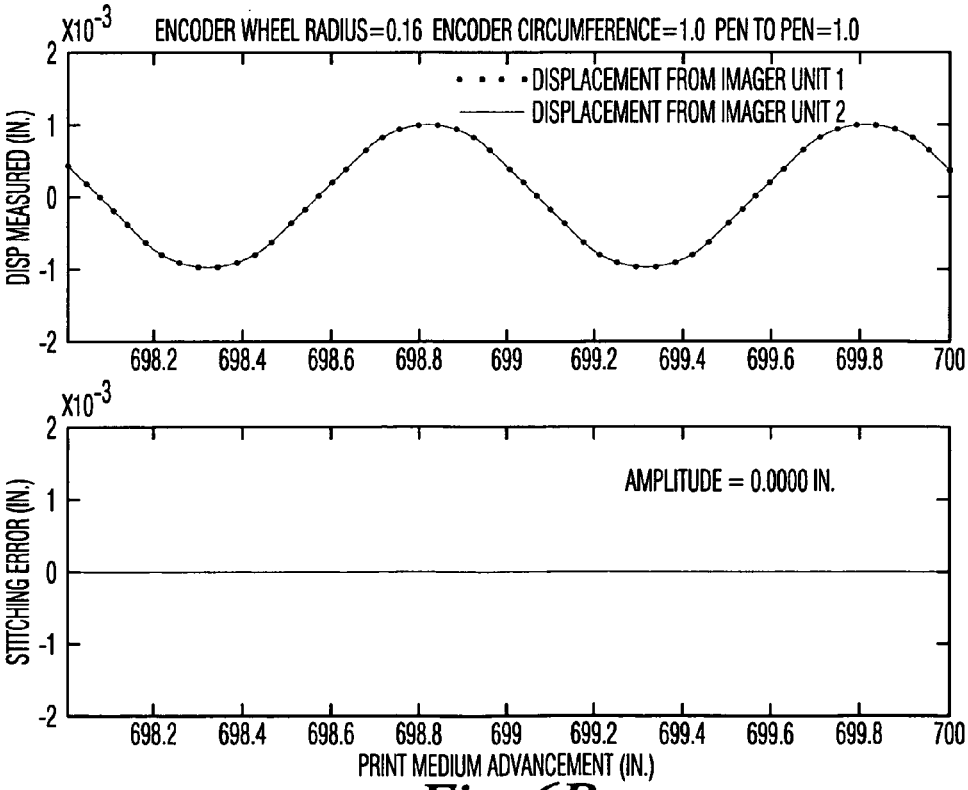

As described in further detail with regard to FIGS. 6A and 6B, when the separation of its associated imager units is an approximate integer multiple (i.e., 2, 3, 4, etc., times) of the circumference of the encoder wheel, the stitching error can become quite small. This results from displacement calculation errors that can be periodic (e.g., sine wave formations) resulting in two imager units becoming in phase with each other when the two imager units print their respective portions of the image.

The periodic displacement calculation errors substantially overlapping means that the displacement error can be substantially equal between an output portion printed by an upstream imager unit associated with and proximate to an encoder wheel and the displacement of an output portion printed by a downstream imager unit relying on the upstream imager unit's encoder wheel and displacement encoder for timing of ink droplet ejection. As a result, the error in stitching of the output portions can be quite small.

In the example illustrated in FIG. 4, the printheads 407 on a first imager unit 406 have formed a bottom portion of an image of a stick man 408. As the print medium 404 advances further, a second imager unit 410 adds a top portion of the stick man 412 to the bottom portion 408 already formed by the first imager unit 406.

Similarly, as the print medium 404 advances, a third imager unit 414 begins a new image by forming a bottom portion 416 of a second stick man. As the print medium 404 advances past a fourth imager unit 418, a top portion 420 of the second stick man is formed. Also shown in FIG. 4 is an encoder wheel 422 positioned proximate to, and upstream of, the first imager unit 406.

Errors contained in signals, in the embodiment of FIG. 4, can have cumulative effects the further downstream from an encoder wheel that is associated with an imager unit that receives instructions from the controller based on data provided by the encoder wheel through its associated displacement encoder, as discussed with respect to the embodiment of FIG. 2.

In FIG. 4, where the imager units can be separated, as described above, by an integer multiple of the circumference of the first encoder wheel 422, for example, the lower portion 408 of the first stick man is formed by the first imager unit 406 based upon positioning information provided by the first encoder wheel 422 and its associated displacement encoder 426. Placement of the upper portion 412 of the first stick man by the second imager unit 410 can also be based upon the same positioning information provided by the first encoder wheel 422 and its associated displacement encoder 426.

If the first encoder wheel 422 contributes an eccentricity error to the positioning information through the displacement encoder 426, and the second imager unit 410 is separated from the first imager unit 406 by an integer multiple of the first encoder wheel's circumference, the controller can provide information to the printheads in the second imager unit 410 for timing of ejection of ink drops to form the upper portion 412 of the first stick man that has a displacement error in phase with that of the displacement error used in printing the lower portion 408 of the first stick man. As a result, in the embodiment of FIG. 4, there is at least substantially no perceivable stitching error in printing of the first stick man, in contrast to the first stick man shown in FIG. 2.

In addition, for example, the lower portion 416 of the second stick man in FIG. 4 can be formed by the third imager unit 414 based upon positioning information provided by the first encoder wheel 422 and its associated displacement encoder 426. Placement of the upper portion 420 of the second stick man by the fourth imager unit 420 also can be based upon the same positioning information provided by the upstream encoder wheel 422 and its associated displacement encoder.

The stitching error of the upper 420 and lower 416 portions of the second stick man in FIG. 4 can be quite small compared to the stitching error shown in FIG. 2 for the second stick man because the separations of the third imager unit and the fourth imager unit from each other and from the first imager unit 406 are integer multiples of the circumference of the first encoder wheel 422. It should be noted that the stitching error illustrated in FIG. 2 is used as an example of a large stitching error and that logic can be used to reduce the stitching error in such embodiments to a very small error, similar to that shown in the embodiment of FIG. 4.

Figure 5:
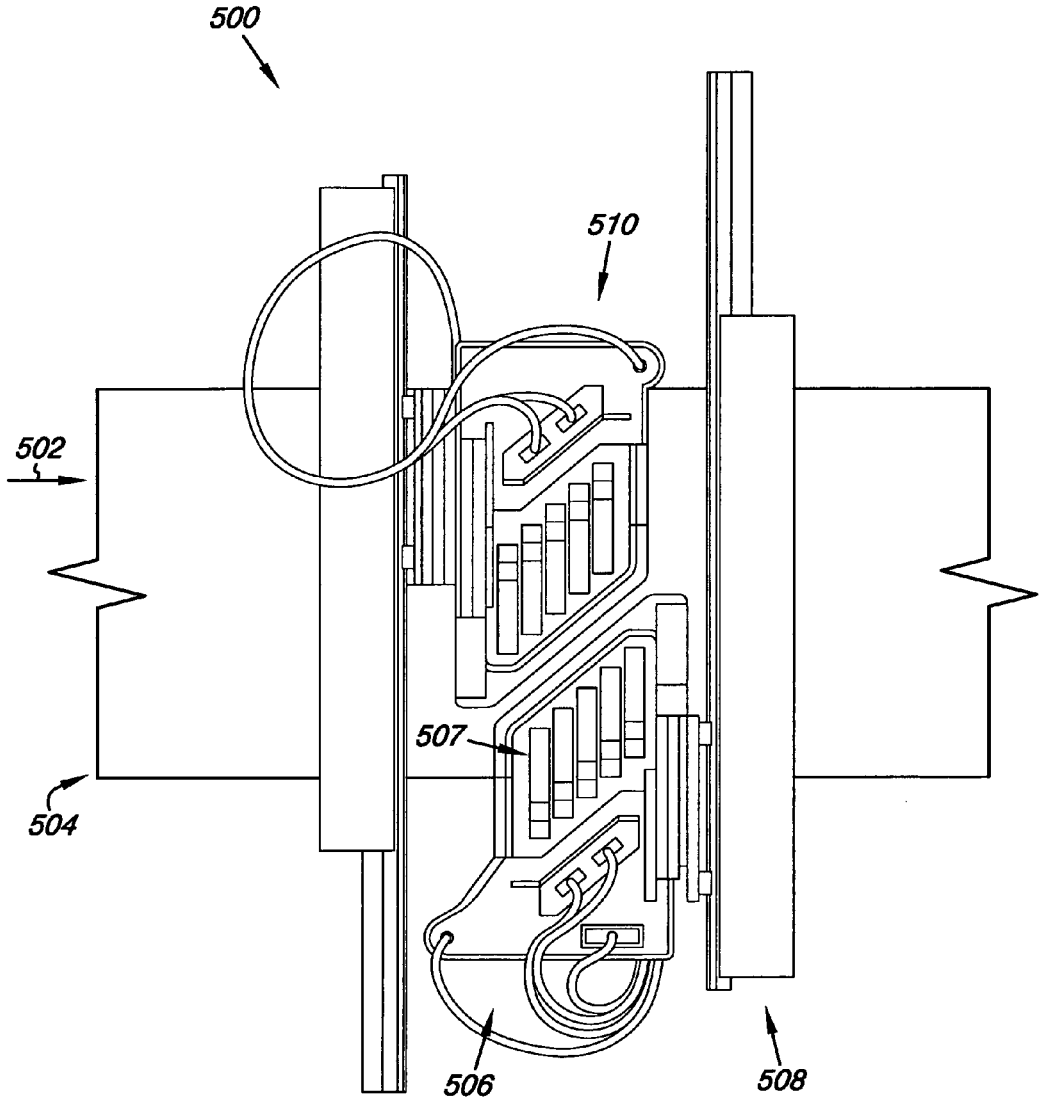
FIG. 5 illustrates another embodiment of a printing system having a number of imager units.

FIG. 5 illustrates another embodiment of a printing system having a number of imager units. As shown in FIG. 5, the components for the printing system apparatus 500 for printing images on the print medium 504 can include a number of imager units (e.g., imager units 506 and 510). Each imager unit can have at least one printhead residing thereon. For example, imager unit 506 is shown with five printheads 507 arranged in a substantially parallel, staggered configuration thereon. Imager unit 510 also is shown to have five printheads thereon by way of example and not by way of limitation. As the print medium 504 progresses in the direction of print medium advancement 502, the printheads in the imager units form at least portions of images by ejecting ink droplets thereon.

Embodiments illustrated in FIG. 5 include repositioning one imager unit of at least one pair of imager units by rotating the one imager unit such that the distance between the two imager units can be reduced. The apparatus configuration 500, shown in the embodiment of FIG. 5, can be accomplished by taking one imager unit of a pair (such as imager unit 418 in FIG. 4) and reconfiguring the imager unit from its former configuration by removing the imager unit 506 and its supporting structure 508 and turning it 180 degrees.

Repositioning the imager unit 506 such that the space between the imager unit 506 and a proximate imager unit 510 (which can be represented by imager unit 414 of FIG. 4) is small allows the distance between two imagers to be reduced. Accordingly, the opportunity for deformation of the print medium occurring between the encoder wheel and the imager unit is reduced, as is the amount of the deformation of the print medium between the encoder wheel and a respective imager unit. As a result, the effect of displacement calculation errors (such as those caused by encoder wheel eccentricity errors, or by deformities, eccentricities, and/or different characteristics in print medium) on output stitching is reduced because the distance between the encoder wheel, and its associated displacement encoder, and the imager unit pair it is associated with is reduced.

In repositioning imager unit imager unit 418 of FIG. 4 into the configuration of imager unit 506 of FIG. 5, the print medium 504 advances from what was formerly the back of the imager unit to what was formerly the front of the imager unit. In such embodiments, logic (such as in controller 140 of FIG. 1) can rotate and reverse the output data that was originally encoded to instruct an imager unit, configured as shown for imager unit 418 in FIG. 4, so as to provide appropriate instructions for ejecting ink droplets from the printheads of imager unit 506.

In some embodiments, the imager unit may include a support structure (e.g., support structure 508) that can be repositioned to allow for adjacent imager units (e.g., units 506 and 510) to be positioned closer to each other. For example, in the embodiment of FIG. 5, the support structure 508 and the imager unit 506 have both been rotated approximately 180 degrees, so that neither of the support structures associated with the imager units 506 and 510 are between the imager units. This configuration allows the imager units 506 and 510 to be placed closer than if one or both of the support structures was in between the imager units.

FIGS. 6A and 6B illustrate graphs representing a correlation between imager unit spacing and stitching error. A displacement, for example measured as illustrated by the vertical axes of the upper graphs in FIGS. 6A and 6B, represents a distance between where a particular portion of an image would have been printed in the absence of error, as indicated by 0 on the vertical axes, and where the particular portion of the image is printed in the presence of error.

The horizontal axes of the upper and lower graphs in FIGS. 6A and 6B illustrate a distance of print medium advancement during a print operation. As illustrated in the embodiment represented in FIGS. 6A and 6B, distances shown on the vertical axes are measured in thousandths (i.e., $\times 10^{-3}$) of an inch and the distances on the horizontal axes are measured in inches.

The upper graph of FIG. 6A shows the effects of a periodic error (e.g., eccentricity), for example, 0.001 inch, on displacement of portions of images printed by an imager unit 1 and an imager unit 2 where each imager unit has a periodic error.

Based upon the spacing of the two imager units in the example analyzed in FIG. 6A, the combination of periodic errors may vary from positive to negative based upon the phases of the two periodic sine-wave-like errors that are present. That is, in this embodiment, the combination of periodic errors can result in a stitching error that is calculated by subtracting the value for the displacement from imager unit 2 from the displacement from imager unit 1. Specifically, in the example illustrated in the bottom graph of FIG. 6A, the amplitude of the stitching error at each point is proportional to the sine of the phase angle of the displacement that, in this example, is visualized as a sine curve having an amplitude of $2\times10^{-3}$ inch.

In the example illustrated in FIG. 6B, the periodic errors are matched to reduce the amplitude of the resultant error. In the example of FIG. 6B, the errors for imager unit 1 and imager unit 2 are sine waves having the same frequency and wavelength. When positioned in phase, the stitching error amplitude is reduced from the arrangement analyzed in FIG. 6A. Specifically, in the example illustrated in FIG. 6A, the stitching error amplitude of displacement at each point is proportional to the sine of the phase angle of the displacement that, as illustrated in FIG. 6B, is visualized as a sine curve having an amplitude of 0.0000 inches.

The stitching error can be empirically determined, for example, by measuring the separation between two lines on an output image that would have been a continuous, unbroken line in the absence of stitching error, among other methods.

FIG. 6A illustrates results obtained when an encoder wheel with an eccentricity has a radius of 0.32 inch, which when multiplied by $2\pi$ yields a circumference of approximately 2 inches, is used in combination with positioning of the imager units 1 inch apart, measured by the distance from a last printhead of imager unit 1 to a first printhead of imager unit 2, or, as labeled in FIGS. 6A and 6B, "PEN TO PEN=1.0". Because the circumference of the encoder wheel is twice the separation of its associated imager units the stitching error is large.

The large stitching error results from displacement calculation errors caused by the encoder wheel eccentricity errors resulting in the sine waves of the two imager units becoming 180 degrees out of phase with each other when the two imager units print their respective portions of the image. Specifically, in the lower graph of FIG. 6A, the resultant stitching error is shown to achieve the maximum amplitude, i.e., 0.0020 inch, because when the displacement from imager 1 is 0.0010 inch the displacement from imager 2 is −0.0010 inch. Subtracting −0.0010 inch from 0.0010 inch yields 0.0020 inch.

FIG. 6B illustrates results obtained when an encoder wheel with a radius of 0.16 inch, which when multiplied by 2π yields a circumference of approximately 1 inch, is used in combination with positioning of the imager units 1 inch apart. Because the circumference of the encoder wheel is approximately equal to the separation of its associated imager units, the stitching error can become zero.

The small stitching error results from displacement calculation errors caused by the encoder wheel eccentricity errors resulting in the sine waves of the two imager units becoming in phase with each other when the two imager units print their respective portions of the image, as shown in the upper graph of FIG. 6B having the two sine waves superimposed on each other. In the lower graph of FIG. 6B, the resultant stitching error is shown to achieve an amplitude of 0.0000 inch, because when the displacement from imager 1 is 0.0010 inch the displacement from imager 2 also is 0.0010 inch. Subtracting 0.0010 inch from 0.0010 inch yields 0.0000 inch.

Unless explicitly stated, the method embodiments described herein are not constrained to a particular order or sequence. Additionally, some of the described method embodiments, or elements thereof, can occur or be performed at the same point in time.

The embodiments described herein can be performed by logic, hardware, application modules, or combinations of these elements, and the like, to perform the operations described herein and/or resident on the systems and devices shown herein or otherwise. Logic suitable for performing embodiments of the present disclosure can be resident in one or more devices or locations. Processing modules can include separate modules connected together or can include independent modules.

A variety of methods can be used to compensate, at least partially, for stitching errors resulting from eccentricity of a displacement encoder and/or its associated encoder wheel and differences in the characteristics of the print medium being used. According to the present disclosure, the method embodiments can include employing at least two displacement encoders and their associated encoder wheels when more than two imager units are utilized, in some embodiments when the imager units are in a staggered configuration; measuring the distance that the print medium has advanced by the displacement encoder having an encoder wheel with a particular circumference that is in contact with the advancing print medium and separating at least two imager units by a distance equal to an integer multiple of the circumference of the encoder wheel of the displacement encoder; and adjusting imager unit separation in a direction of print medium advancement based upon a measured speed variation. Method embodiments can also include positioning the imager units at a distance that is closely proximate such that a deformation of the print medium at one or more positions is reduced and repositioning one imager unit of at least one pair of imager units by rotating the imager unit 180 degrees such that the distance between the two imager units can be reduced.

The cumulative effect on stitching errors resulting from alignment or eccentricity errors of the displacement encoder and its associated encoder wheel and/or differences in the characteristics of a print medium can be reduced, for example, by employing at least two displacement encoders and their associated encoder wheels when more than two imager units are utilized. By so doing, encoding errors contributed by a first displacement encoder and its associated encoder wheel can be compensated for, at least partially, by a second displacement encoder and its associated encoder wheel downstream supplying data to be used in determining firing of printheads in a third, or subsequent, imager unit. Such method embodiments can include having a first displacement encoder and its associated encoder wheel associated with and proximate to a first imager unit and having a second displacement encoder and its associated encoder wheel associated with and proximate to a third imager unit.

In some embodiments, the method can include utilizing an even number of imager units and associating the imager units in pairs with one or more displacement encoders and their associated encoder wheels associated with and proximate to each imager unit pair and positioned upstream from the imager units relative to the direction of print media advancement, which can enable signals regarding advancement of print medium to be used in processing instructions for both imager units in the pair associated with the encoders. Unless specified otherwise in the present disclosure, proximate can mean that the referred to components are near each other. In such usage, either component can be positioned upstream or downstream of the other component relative to the direction of print medium advancement.

In various embodiments, a method of the present disclosure can include employing a third displacement encoder and associated encoder wheel associated with and proximate to the second imager unit to enable signals regarding advancement of the print medium to be used in processing instructions for an output to be printed in concert with at least the third imager unit, where the third displacement encoder and associated encoder wheel is located proximate to the second imager unit. Some embodiments can include switching between the first displacement encoder and associated encoder wheel associated with and proximate to the first imager unit, for printing using a first pair of imager units including the first imager unit and the second imager unit, and the third displacement encoder and associated encoder wheel associated with and proximate the second imager unit, for printing using a second pair of imager units including the second imager unit and the third imager unit.

Method embodiments can also include compensating, at least partially, for encoding errors by measuring the distance that the print medium has advanced by the displacement encoder having an encoder wheel with a circumference that is in contact with the advancing print medium and separating two imager units by a distance equal to an integer multiple of the circumference of the encoder wheel of the displacement encoder. Some embodiments can include separating two imager units by a distance equal to an integer multiple of the circumference of the encoder wheel of the displacement encoder where the separation distance is the distance from a last printhead of a first imager unit to a first printhead of a second imager unit.

In various embodiments, if a diameter of the encoder wheel is selected such that one circumference of the encoder wheel equals the separation of its associated imager units, for example, as measured from a last printhead of a first imager unit to a first printhead of a second imager unit, stitching error can be reduced. This can result in instances where displacement calculation errors caused by encoder wheel eccentricity errors become in phase with each other when the two imager units print their respective portions of an image.

In instances where the diameter of the encoder wheel is selected such that one half the circumference of the encoder wheel equals the separation of its associated imager units, the stitching error can be increased relative to a previously evident stitching error. This can result from displacement calculation errors caused by the encoder wheel eccentricity errors becoming 180 degrees out of phase with each other when the two printheads print their respective portions of an image, among other causes.

In some embodiments, for a given encoder wheel circumference, stitching error can be reduced by adjusting positioning of the imager units by changing the distance from a last printhead of a first imager unit to a first printhead of a second imager unit within a pair of imager units such that the separation is a distance equal to an integer multiple of the circumference of the encoder wheel of the displacement encoder. This can be because the displacement calculation errors caused by the encoder wheel eccentricity errors may remain in phase with each other when the imager unit separation distance is equal to an integer multiple of the circumference of the encoder wheel, e.g., 2, 3, 4, etc., times the encoder wheel's circumference. For example, displacement calculation errors caused by the encoder wheel eccentricity errors, for instance, can remain in phase with each other when the imager unit separation distance between imager unit 1 and imager unit 4 in FIG. 4 is equal to an integer multiple of the circumference of the first encoder wheel 422.

In various embodiments, the method can include compensating for, at least partially, other periodic aberrations, including different characteristics (e.g., deformities, eccentricities of the print medium or roll of print medium, mount characteristics, such as roll tension changes when mounted, and other such characteristics of the roll or medium that may alter the speed or positioning of the print medium) of the print medium, such as cut sheets and/or a roll of continuous web print medium. The reduction of errors based upon such issues can be accomplished, for example, by measuring a speed variation in the advancement of the print medium based upon a rotation speed of an encoder wheel and adjusting imager unit separation in a direction of print medium advancement.

In various embodiments, the method can include compensating, at least partially, for encoding errors by positioning the imager units at a distance that is closely proximate such that an opportunity for deformation of the print medium at one or more positions is reduced. In some embodiments the method can include analyzing deformation of the print medium at one or more positions and positioning the imager units based upon the analysis at a distance that is closely proximate such that a probability is reduced for the deformation of the print medium at the one or more positions being present between the imager units during a print job.

In various embodiments, a method can include compensating, at least partially, for encoding errors by positioning at least one encoder wheel and its associated sensor at a distance that is closely proximate to an associated imager unit such that the opportunity is reduced for deformation of the print medium occurring between the encoder wheel and the imager unit. That is, the probability can be reduced for the deformation of the print medium being present between the encoder wheel and the imager unit.

Embodiments of the present disclosure include associating one imager unit with any one or more other imager units in the printing system to achieve greater coordinated print alignment by configuring the chosen imager units so as to separate the imager units a specified distance apart and/or to reduce the distance between imager units and their associated displacement encoder. This can be accomplished, for example, if the units are separated by an integer multiple of the circumference of the encoder wheel of the upstream imager unit's displacement encoder. This can also be accomplished by using one or more encoders that are proximate to at least one of the associated imagers, among other disclosed manners.

In various embodiments, a user of the printing system can use a graphic user interface (GUI) to visualize a matrix of imager units in the printing system, along with the displacement encoders of the system. In such embodiments, the GUI can allow the user to select which imager units are to be associated with each other and/or which encoders are to be associated with the associated imagers.

For example, in some embodiments, the user can "drag and drop" or click to select the imager units to be associated. In various embodiments, the printing system can analyze the image to be printed and automatically select the imager units to be separated by an integer multiple of the circumference of the encoder wheel of the upstream imager unit's displacement encoder to more accurately stitch the imager unit's output.

Variations on the approaches described herein are applicable in other image forming systems, such as those with different fixed-head configurations and those with scanning-head imagers. For example, printheads and/or imager units that eject specified colors of ink droplets can be arranged in-line and have the output of the printheads and/or imager units stitched utilizing embodiments of the present disclosure.

As another example, two or more printheads and/or imager units can be arranged in-line and be designated for printing adjacent sections of an image in a Y direction, as shown in FIG. 1, which can result in the image being rendered faster, and have the output of the printheads and/or imager units stitched utilizing embodiments of the present disclosure. For example, in some embodiments, the bottom of an image portion printed by imager unit 4 in FIG. 4 could be more accurately stitched with the top of an image portion subsequently printed by imager unit 1, if the imager units were arranged in an in-line configuration with imager unit 1 and imager unit 4 separated by an integer multiple of the circumference of encoder wheel 422. Additionally, embodiments can include non-fixed and non-staggered printhead and/or imager unit array arrangements.

Although specific embodiments have been illustrated and described herein, those of ordinary skill in the art will appreciate that an arrangement calculated to achieve the same techniques can be substituted for the specific embodiments shown. This disclosure is intended to cover all adaptations or variations of various embodiments of the present disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. An apparatus for printing, comprising:

a print medium advancement mechanism;

at least one displacement encoder having an encoder wheel of a circumference to provide a signal representing advancement of print medium by the print medium advancement mechanism;

at least two imager units separated by an integer multiple of the circumference of the encoder wheel of the displacement encoder; and a processor configured to stitch output from the at least two imager units using the signal, wherein the at least one displacement encoder includes a first displacement encoder associated with and proximate to a first imager unit, a second displacement encoder associated with and proximate to a third imager unit, and a third displacement encoder associated with and proximate to a second imager unit, wherein the processor is configured to switch between the first displacement encoder for printing using a first pair of imager units including the first imager unit and the second imager unit, and the third displacement encoder for printing using a second pair of imager units including the second imager unit and the third imager unit.

2. The apparatus of claim 1, wherein the at least two imager units receive signals from the processor containing instructions for printing on the print medium, including stitching of an output from the at least two imager units.

3. The apparatus of claim 1, wherein the at least two imager units are arranged in pairs with one or more displacement encoders associated with and proximate to each imager unit pair.

4. The apparatus of claim 3, wherein the one or more displacement encoders associated with and proximate to each imager unit pair are positioned upstream from the associated imager unit pair relative to the direction of print media advancement.

5. The apparatus of claim 1, further comprising at least four imager units wherein the third imager unit and a fourth imager unit are associated with the second displacement encoder.

6. An apparatus for printing, comprising:

a print medium advancement mechanism;

a first displacement encoder having an encoder wheel of a circumference to provide a signal representing advancement of the print medium;

at least two imager units separated by an integer multiple of the circumference of the encoder wheel of the displacement encoder; and a processor configured to stitch output from the at least two imager units using the signal, further comprising at least four imager units wherein the first displacement encoder is associated with and proximate to a first imager unit and a second displacement encoder is associated with and proximate to a third imager unit, wherein the third imager unit and a fourth imager unit are associated with the second displacement encoder, further comprising a third displacement encoder associated with a second imager unit and the third imager unit.

7. The apparatus of claim 6, further comprising a mechanism to switch from use of at least one of the first and second displacement encoders to use of the third displacement encoder.

8. The apparatus of claim 6, wherein the first displacement encoder is upstream of the first imager unit, the second displacement encoder is upstream of the third imager unit, and the third displacement encoder is upstream of the second imager unit.

9. The apparatus of claim 1, wherein at least one imager unit of the at least two imager units is positioned such that it is rotated 180 degrees with respect to at least one other imager unit such that the distance between two imager units can be reduced.

10. The apparatus of claim 1, wherein the at least two imager units are arranged in a staggered configuration and are separated by a distance equal to an integer multiple of the circumference of the encoder wheel of the displacement encoder.

* * * * *

UNITED STATES PATENT AND TRADEMARK OFFICE

CERTIFICATE OF CORRECTION

PATENT NO. : 7,530,659 B2
APPLICATION NO. : 11/395446
DATED : May 12, 2009
INVENTOR(S) : Neil Doherty et al.

It is certified that error appears in the above-identified patent and that said Letters Patent is hereby corrected as shown below:

In column 2, line 11, after "logic" insert -- to --.

Signed and Sealed this

Seventeenth Day of November, 2009

David J. Kappos

David J. Kappos
*Director of the United States Patent and Trademark Office*